US005740885A

United States Patent [19]

Paradise

[11] Patent Number: 5,740,885

[45] Date of Patent: Apr. 21, 1998

[54] FIREPROOF WATER-COOLED ESCAPE CABLE AND METHOD

[76] Inventor: William Paradise, 515 Wood Forest Ct., NE., Marietta, Ga. 30066

[21] Appl. No.: 513,402

[22] Filed: Aug. 10, 1995

[51] Int. Cl.[6] ..... A62B 1/00

[52] U.S. Cl. ..... 182/190; 182/230

[58] Field of Search ..... 138/131; 182/70, 182/190, 230; 239/547, 450, 522

[56] References Cited

U.S. PATENT DOCUMENTS

| | | | |
|---|---|---|---|
| 149,669 | 4/1874 | Miller . | |
| 335,414 | 2/1886 | Bailey . | |
| 724,953 | 4/1903 | Schaller . | |
| 1,288,148 | 12/1918 | Oden | 138/131 X |
| 1,484,575 | 2/1924 | Shulin | 138/131 X |
| 1,900,511 | 3/1933 | Madden | 138/131 X |
| 2,028,793 | 1/1936 | Mascuch | 138/131 X |
| 2,814,529 | 11/1957 | Arnt | 239/450 X |
| 3,201,507 | 8/1965 | Johnsen | 239/450 X |
| 3,539,106 | 11/1970 | Ramik . | |
| 3,777,987 | 12/1973 | Allport | 239/547 X |

*Primary Examiner*—Alvin C. Chin-Shue
*Attorney, Agent, or Firm*—Thomas, Kayden, Horstemeyer & Risley, L.L.P.

[57] ABSTRACT

A fireproof water-coolable escape cable and method permits the quick evacuation of persons and objects from the upper floors of a building or other structure in the event a fire or other emergency blocks or otherwise makes unavailable the normal routes of egress from the structure. The cable has an elongated hollow tubular core with a plurality of perforations therethrough and has a plurality of cables wrapped around the core. The perforations permit water or other fluids to be conducted to the surface of the cable for dissipating the heat applied thereto.

11 Claims, 3 Drawing Sheets

FIREPROOF WATER-COOLED ESCAPE CABLE AND METHOD

FIELD OF THE INVENTION

The present invention generally relates to emergency escape devices used to exit buildings when the normal paths or points of exit are no longer accessible, and more particularly, to a fire-escape device and method for lowering persons and/or objects along the exterior of a building from the upper levels or stories of a building to the ground.

BACKGROUND OF THE INVENTION

Various apparatus and techniques are known in the art for evacuating persons and objects from the upper stories of buildings during an emergency which blocks the normal exit routes at ground level. Typically, fire-escape ladders of various design are either permanently or temporarily attached to the exterior walls of a building near windows or other openings so that persons can transport themselves and other objects from the upper floor openings to the ground below. Several fire-escapes function solely as ladders or stairwells leading from the upper story windows to the ground, while others function both as ladders and conduits for the delivery of water from the ground below to the building above. The devices have been disclosed in, for example, U.S. Pat. Nos. 149,669, to Miller, 335,414, to Bailey, and 724,953, to Schaller. A brief discussion of these prior art devices is set forth hereafter, but it should be noted that this discussion is not exhaustive.

One type of water delivering ladder is described in U.S. Pat. No. 149,669, to Miller. The patent discloses a ladder having hollow side rails extending vertically and parallel to one another with hollow rungs extending perpendicular to and connecting the side rail beams. The lower end of the ladder is connected to a water source and the upper end of the ladder is attached to the side or roof of a building. Spray nozzles are located at various points along the length of the side rails and on a number of the rungs. During a building fire, the nozzles are opened to allow water to circulate through the side rails and rungs in order to cool the ladder. In addition, water discharged from the nozzles is directed into the house and onto the roof in order to help combat the fire.

U.S. Pat. No. 335,414, to Bailey, discloses a fire-escape shaft which is fixedly secured to a side of a building. The shaft comprises a rigid tubular member having a hollow center for transporting water from a water source on the ground to the top of the shaft near the roof of the building. The shaft is fixedly secured to the side of the building and has a concave solid cap fastened at its upper end. When water is fed to the lower end of the shaft, the water is forced upward until it exits the upper end of the shaft and strikes the concave cap. The result is water showering downward over and around the shaft. Due to the wetting and cooling effect of the water, people are able to exit the building by sliding down the shaft.

U.S. Pat. No. 724,953, to Schaller, discloses an improvement in a fire ladder. The ladder has hollow side rails and rungs which allow for the circulation of water when the spray nozzles are opened to combat a fire. In addition to these features, the ladder is portable and comprises a plurality of sections. These sections can be fitted together to form a ladder of varying height.

Although the fire-escape devices of the prior art are useful once put into operation by the fire department, they are of limited value if the water supply at ground level is inadequate. In the event heat from a fire within a building reaches one of the prior art devices prior to their connection to a water supply, the devices will quickly become too hot for someone to use and thus unavailable as an escape route. Moreover, even if an adequate water supply is connected to a prior art device, the exterior surface, or at least a portion thereof may still become too hot to touch.

With respect to the ladder type prior art devices, water circulating within the ladder is never applied directly to the exterior surface. Therefore, the heat transferred from a fire to the exterior surface of the ladder will quickly overtake the rate of heat dissipation at the ladder's surface due to flowing water within the device. With respect to the showering type prior art devices, a similar problem occurs. Although water is actually being applied to the surface of these prior art devices, the water application occurs only at the upper end of the shaft. The weight of the water and forces of gravity are all that carry the water downward over the entire length of the shaft's exterior surface. Again, the heat from an intense fire within the building will cause the water to turn to steam, thereby evaporating the water before it ever reaches the lower surface of the shaft. The result is again an exterior surface that quickly becomes too hot to touch and ineffective as a long term fire-escape device.

An additional drawback to the prior art devices involves the water supply source. Typically, these devices are connected via a hose to fire hydrants located on the street. Since fire hydrants are infrequently used, it is common for rocks and other large pieces of debris to be found in the water mains beneath the hydrants. When the fire hydrants are opened and water released, the rocks and debris are discharged from the hydrants and may become lodged within the hollow orifices of the prior art devices, thereby blocking the orifices and reducing water flow. The result is additional reduction in the cooling capabilities of the prior art devices. Moreover, many of the prior art devices are prepositioned in fixed locations and may not be accessible to all persons within the building. Likewise, the portable ladder prior art devices require assembly and are usually supplied by the fire department. In many instances, these devices may not be assembled and operational in time to be of use to those trapped in the building. Finally, many of the prior art devices are limited with respect to the number of persons that can use the device at any one time. Evacuation is therefore slow at a time when a high rate of egress from the building is essential.

SUMMARY OF THE INVENTION

Therefore, an object of the present invention is to overcome the deficiencies and inadequacies of the prior art as noted above and as generally known in the art.

Another object of the present invention is to provide an emergency fire-escape device and method for immediate connection to an adequate water supply by a person requiring the use of the device.

Another object of the present invention is to provide a device and method for quickly and adequately delivering water or other fluid to the entire exterior surface of the device so that heat dissipation is at its maximum where persons will contact the device.

Another object of the present invention is to provide a device that can be connected to an adequate water source which is free and clear of rocks and other debris.

Another object of the present invention is to provide a device that is readily available to everyone in a building in the event of an emergency which requires the immediate evacuation from the upper floor openings.

Another object of the present invention is to provide a fire-escape device and method that is simple and inexpensive to manufacture and which is easy to employ.

Another object of the present invention is to provide a fire-escape device and method which can be employed without the aid of the fire department.

Another object of the present invention is to provide a fire-escape device that can transfer a large number of people from the upper floors of a building to the ground below in a short period of time.

Briefly described, the present invention provides for a fireproof water-cooled escape cable and associated method for evacuating persons and objects from the upper floors of a building during an emergency situation. The cable comprises an elongated hollow core having perforations and metal cable strands spiraled about the core in a braided fashion. In addition, one end of the cable can be fitted with a water nozzle adaptor for connection to any number of standard water faucets or spigots. The water nozzle adaptor is adapted to receive one end of the cable and the discharge end of a faucet or spigot. Water from the faucet is then conducted throughout the length of the channel formed at the interior of the elongated core.

In order to form the core, steel sheeting of sufficient strength and thickness is laid flat and punched so that a plurality of holes penetrate the thickness of the sheeting throughout its length and width. The metal sheeting is then hot rolled lengthwise so that the edges of the sheeting come in contact with each other, thereby creating a seam. A porous tubular core having a longitudinal channel running from one end of the core to the other is thus formed. Individual flexible metal cable strands are then sequentially wrapped about the core from one end of the core to the other in a spiraling fashion until the entire exterior surface of the core is covered by a layer of cable strands. Additional cable strands are then wrapped about the first layer of cable strands in a similar fashion so that a second layer of cable strands overlaps the first layer. Subsequent layers of cable strands are then added until the cable reaches a desired circumference. A water spigot fitting can then be attached to one end of the cable by any number of conventional means such as; for example, pressure fittings, male/female screwed fittings, clamp ring fittings, sleeve fittings, and other similar fittings commonly known in the art.

In operation, the fire proof water-cooled escape cable is used to assist persons and objects in their descent along the exterior of a building during an emergency situation. The cable is first wrapped about an object in the building and then connected to the nearest water faucet or spigot, or other fluid source. The object about which the cable is wrapped must be strong enough or heavy enough to support the combined weight of the persons and/or objects descending the cable at any given time. The remainder of the cable is then lowered out an opening in the building, such as a window, until the end of the cable reaches the ground and all of the slack is out of the cable. Water is then supplied to the cable by turning on the faucet or spigot. The water travels through the longitudinal channel at the center of the core while a portion of the water is simultaneously forced in a direction transverse to the channel through the perforations in the core wall. The water continues to travel between the gaps in the metal cable strands until it eventually reaches the exterior surface of the cable in the form of water or steam.

Once employed, the cable can be descended in a variety of ways. If time is of the essence, the cable can be descended without the aid of any mechanical device. Using gloves or some other form of hand protection, the cable is gripped hand over hand as the individual backs out of the window or other opening. The individual then continues walking backwards in a downward direction along the face of the building while alternating his grip hand over hand in order to control the rate of descent. Alternatively, a faster means of descending the cable involves grasping the cable in a hand over hand fashion while looping the cable around one leg in a spiraling fashion. The second leg is then intertwined with the first leg such that the cable is interlocked between the individual's feet. The individual then slides down the cable while using his feet to impart pressure against the cable in order to brake during the descent.

Mechanical devices can also be employed to assist an individual during the descent of the cable. Buoy seats with hand operated brake units, harness and snap link systems such as those used by mountain climbers, and a variety of other systems commonly used by fire and rescue units to lower injured persons from high elevations could be used as well. If more complex equipment, such as a helicopter, is available, the distal end of the cable can be transported to the rooftop of an adjacent building below, and secured thereto. Larger and more complex transport systems such as gondolas commonly found at amusement parks can be secured to the cable and used to transport a large number of people at the same time.

The water or other fluid being applied to the surface of the cable dissipates the heat transferred to the surface of the cable by the multiple braking actions and the building fire. The amount of water reaching the surface of the cable is dependent upon a plurality of factors. The distal end of the cable can remain open and unobstructed which will result in the least amount of water reaching the surface of the cable. If required, the size of the channel opening at the distal end of the cable can be reduced or plugged which will result in an increased or maximum amount of water reaching the surface of the cable. In addition, since the longitudinal seam of the metal core is not welded, extreme temperatures from a building fire will cause the metal core material to expand, thus separating the core at the seam and allowing additional water to reach the surface of the cable in order to cool it. Moreover, the size of the perforations can be increased or decreased during manufacture in order to increase or decrease, respectively, the amount of water that reaches the cable surface.

There are many other advantages of the present invention, as set forth hereafter.

An advantage of the present invention is that each room having an opening to the exterior of the building can be equipped with a device for safely exiting the building from that location during an emergency.

Another advantage of the present invention is that the device can be used with or without a water supply.

Another advantage of the present invention is that existing multi-story buildings can be retrofitted with the device at minimal cost.

Another advantage of the present invention is that small light weight units can be manufactured so that every home owner and traveler can take the device with them for use in their homes, motels or other multi-story buildings.

Other features, objects, and advantages of the present invention will become apparent to one of skill in the art upon examination of the following drawings and detailed description.

BRIEF DESCRIPTION OF THE DRAWINGS

The present invention can be better understood with reference to the following drawings. The drawings are not necessarily to scale, emphasis instead being placed upon clearly illustrating the principles of the present invention.

DETAILED DESCRIPTION OF THE PREFERRED EMBODIMENT

Figure 1:
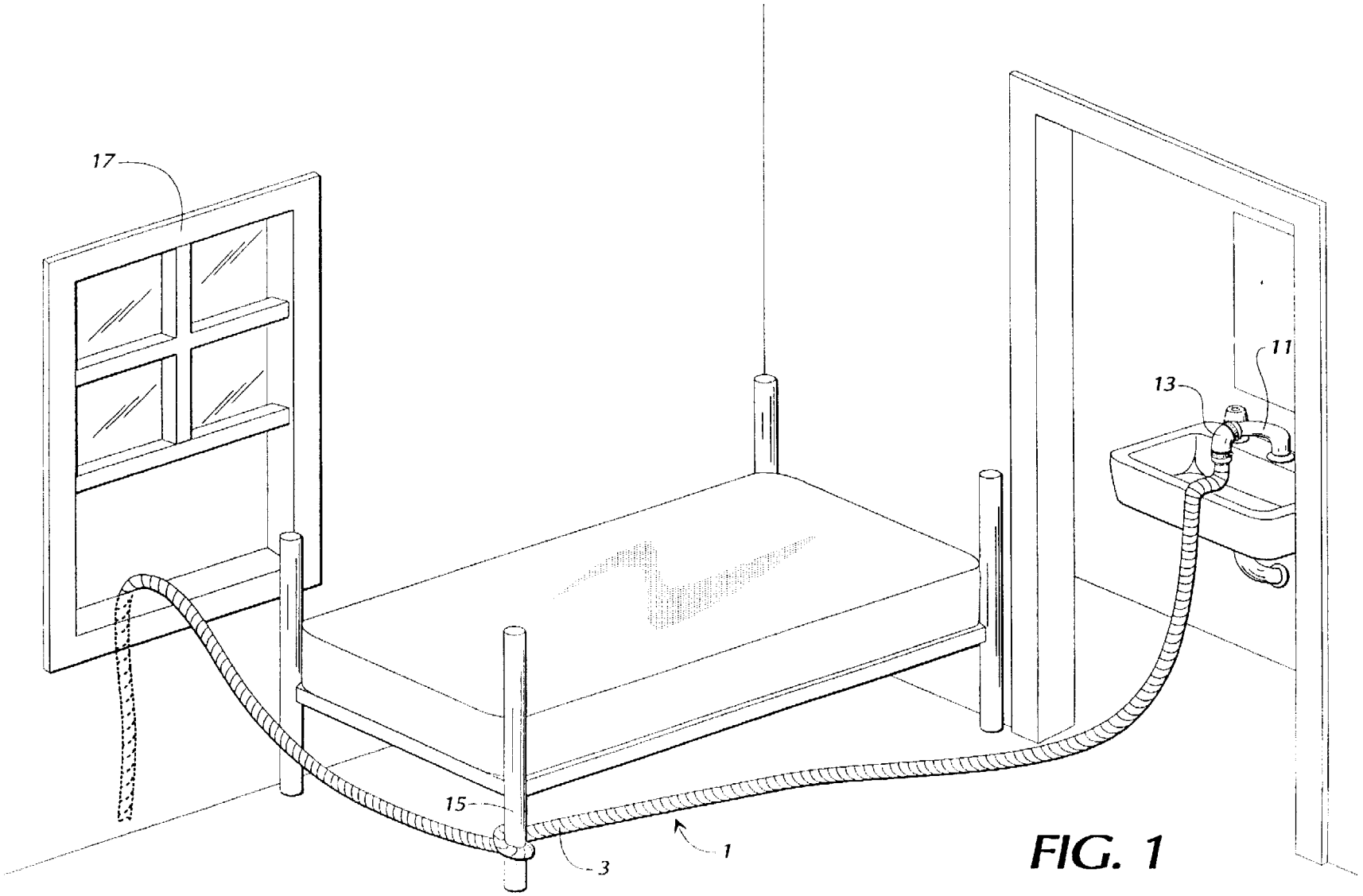
FIG. 1 is a perspective view illustrating a cable according to the present invention secured to an object and connected to a standard water faucet.

Referring now to the drawings wherein like reference numerals designate corresponding parts throughout the several views, a water-cooled escape cable 1 of FIG. 1 is wrapped about a support fixture 15 within a building and is coupled to a water spigot 11 by means of a water spigot coupling 13.

Figure 2:
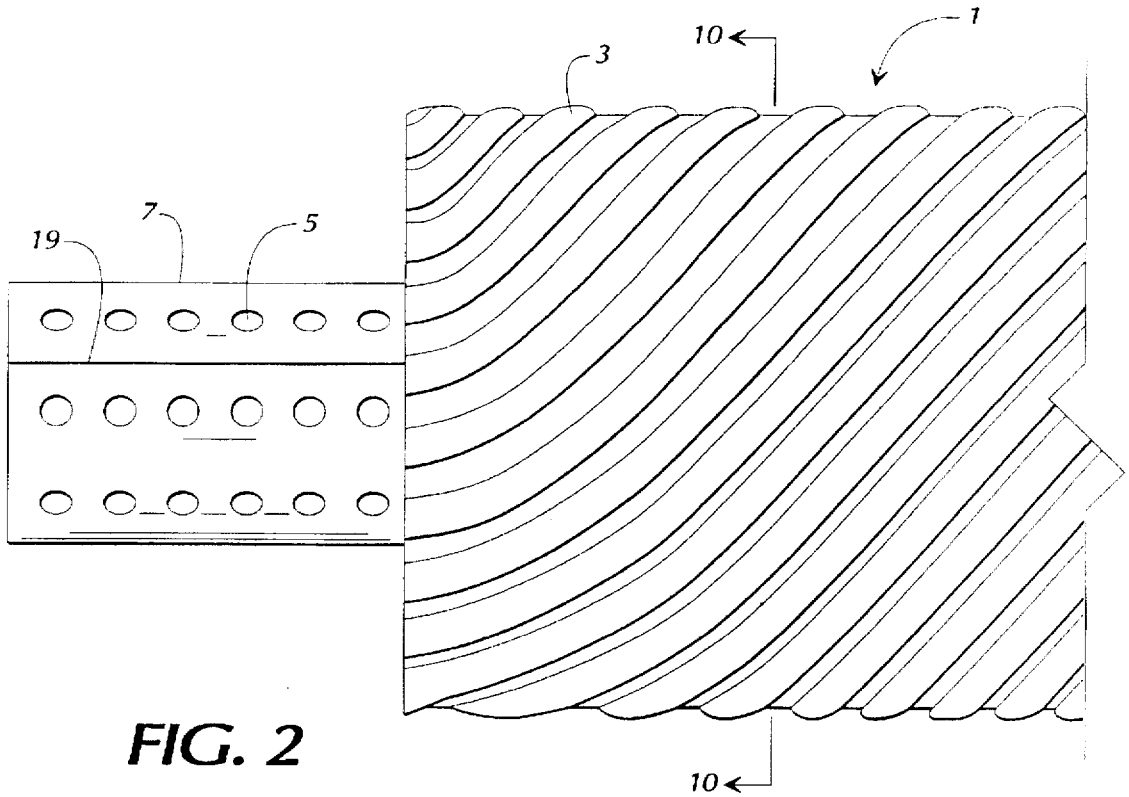
FIG. 2 a side cutaway view of the cable of FIG. 1 illustrating the perforated core within the metal cable strands.
Figure 3:
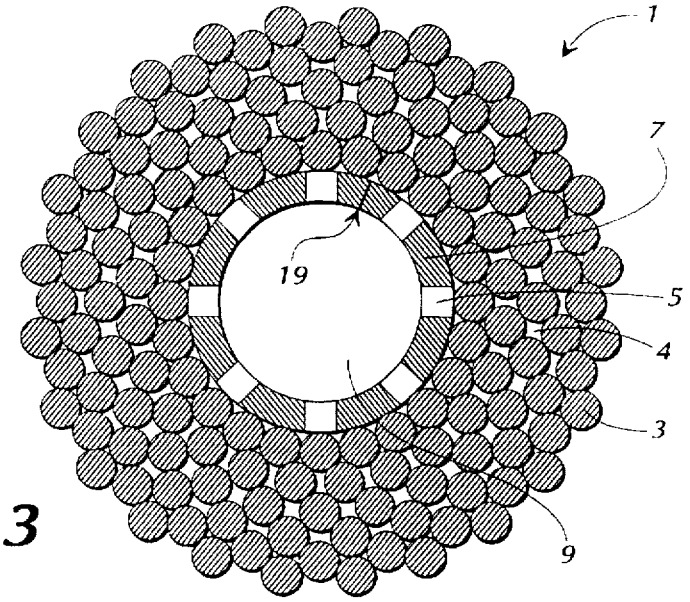
FIG. 3 is a cross-sectional view of the cable of FIG. 1 along line 10—10 of FIG. 2 and illustrates layers of metal cable strands surrounding a perforated hollow core and a longitudinal channel passing therethrough.

Structurally, the water-cooled escape cable 1 as shown in FIGS. 2 and 3 comprises an elongated core 7 defining a plurality of perforations 5, a plurality of flexible cable strands 3 wrapped about said core 7 in overlapping fashion, a plurality of air pockets 4 formed between successive layers of said flexible cable strands 3, and a longitudinal channel 9 for conducting water therethrough.

In the preferred embodiment, the water-cooled escape cable 1 is manufactured with an all metal construction. Stainless steel sheeting is laid flat and fed through a punch-press whereby a plurality of the perforations 5 or holes are formed in the sheeting. The sheeting is then hot rolled to form the hollow elongated core 7 which is tubular in shape and opened at each end. Individual flexible cable strands 3 of galvanized steel are then wound about the core 7 from one end of the core 7 to the other in a spiralling fashion. Subsequent strands 3 are wound about the core 7 adjacent to and touching the previously wound strand 3 until a layer is formed. Additional layers of strands 3 are wound about the core 7 in overlapping fashion until the cable 1 reaches the desired size and strength. Since the cable strands 3 are substantially cylindrical in shape, air pockets 4 are formed between adjacent cable strands 3.

The cable strands 3 serve several functions. First, since a seam 19 formed in the wall of the elongated core 7 during the rolling process remains unwelded, the cable strands 3 structurally support the core. Moreover, the cable strands 3 allow fluids from the longitudinal channel 9 within the core 7 to permeate through the several layers of cable strands 3 to the exterior surface of the water-cooled escape cable 1. Further, the cable strands 3 form a grip at the surface of the escape cable 1 for persons descending the cable 1 during the evacuation of a building. While the escape cable 1 has been described as having a stainless and galvanized steel construction, it is to be understood that the cable strands 3 and core 7 may comprise any flame resistant, nonoxidizing material such as aluminum or titanium provided it has sufficient strength and flexibility to meet design requirements.

In the event a fire or other emergency requires the immediate evacuation of a building from other than the ground floor, the water connection end of the escape cable 1 is repetitively wrapped about a support fixture 15 in the building. The remainder of the cable 1 is then dropped out of a window 17 or other exterior opening on the building so that the distal end of the cable 1 is at or near the ground below. The water connection end of the cable 1 is then attached to any standard water spigot or faucet 11 by any means commonly known in the art, such as, but not limited to, pressure fittings, sleeve attachments, clamping rings, or male/female screwed fittings. The water spigot coupling 13 can be fixedly secured to the escape cable 1 during manufacture, or it can be attached to the cable 1 at the same time it is attached to the water spigot 11. When the water supply is turned on, water is forced through the longitudinal channel 9. As the water is conducted toward the distal end of the cable 1, water is forced from the longitudinal channel 9 through the perforations 5 and into the air pockets 4 between the flexible cable strands 3. The water flow and pressure within the channel 9 forces the water to continue to permeate through and between the cable strands 3 until the water reaches the exterior surface of the escape cable 1.

To use the water-cooled escape cable 1 herein described, a person grasps the exterior surface of the cable 1 first with the hands and then with the legs. A person then lowers himself by moving the hands downward in a hand over hand fashion while applying pressure to the cable 1 with the hands and feet in order to slow the descent until the ground below is reached. The rapidity of descent is regulated by tightening and loosening the grip of the hands and feet upon the cable 1. Descent of the cable 1 can also be accomplished using a harness or buoy seat provided with some form of cable attachment and mechanical braking system. The maximum number of persons that may descend the cable 1 at any given time is a function of the strength of the cable material used and the diameter of the cable.

The water supplied to the cable 1 functions as a coolant to the exterior surface of the cable 1. Water reaching the surface of the cable 1 dissipates the heat applied to the cable by the frictional forces associated with braking, and by a fire within the building in the proximity of the cable 1. As the temperature of the cable 1 increases, the metal components of the cable 1 expand causing the seam 19 to separate thereby allowing more water to flow into the air pockets 4 between the cable strands 3 so that additional heat can be dissipated at the surface of the cable 1.

Figure 4:
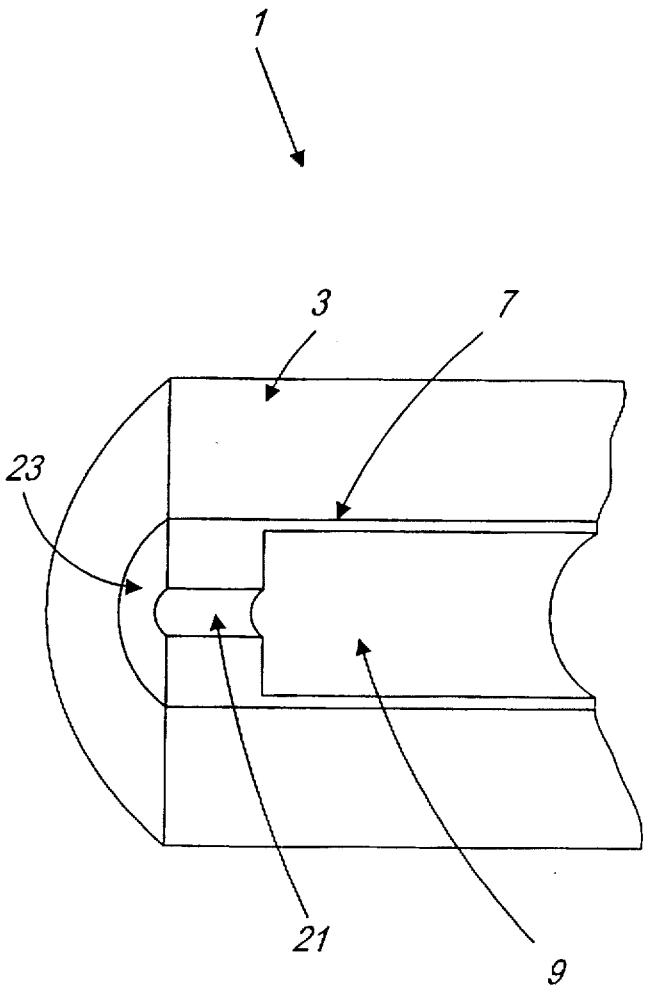
FIG. 4 is a cutaway view of the distal end of the cable of FIG. 1 showing a reduced diameter of the distal end.

In accordance with the preferred embodiment of the invention, the longitudinal channel 9 of the elongated core 7 has a uniform diameter throughout its length. In an alternative embodiment of the invention shown in FIG. 4, the diameter 21 of the distal end 23 of the longitudinal channel 9 may be reduced in comparison with the diameter of the remainder of the channel 9. In such an embodiment, the resulting increase in water pressure within the longitudinal channel 9 will increase the rate at which water is discharged from the perforations. Moreover, reducing the diameter 21 of the distal end 23 of the longitudinal channel 9 to 0, or plugging the distal end 23 of the longitudinal channel 9 will maximize the water flow through the perforations 5.

It will be apparent to one of skill in the art that many variations and modifications may be made to the preferred embodiments as described above without substantially departing from the principles of the present invention. All such variations and modifications are intended to be included herein and within the scope of the present invention, as set forth in the following claims.

Wherefore, the following is claimed:

1. A fireproof water-cooled cable, comprising:

an elongated hollow core having perforations;

a longitudinal seam along said core;

metal cable strands wrapped about said core, wherein a plurality of gaps are located between said metal strands;

a water spigot fitting affixed to said cable; and said cable is capable of allowing water to pass through said core to cool said cable, and said cable is capable of forcing a portion of said water to travel transverse to said core through said perforations and through said gaps to the exterior surface of said cable.

2. The cable of claim 1, wherein said core is a rolled metal piece.

3. The cable of claim 1, further comprising a distal end with a diameter smaller than the diameter of said core.

4. The cable of claim 1, further comprising a grip surface formed by said metal cable strands.

5. The cable of claim 1, wherein said longitudinal seam is capable of thermal expansion, thereby allowing greater flow of water through said seam and said gaps when said cable is subjected to heat.

6. The cable of claim 1, wherein the tensile strength of said cable is great enough to bear the weight of at least one person.

7. The cable of claim 5, wherein the tensile strength of said cable is great enough to bear the weight of at least one person.

8. The cable of claim 7, further comprising a distal end with a diameter smaller than the diameter of said core.

9. The cable of claim 8, wherein said core is a rolled metal piece.

10. The cable of claim 9, wherein said metal cable strands are galvanized steel.

11. The cable of claim 10, further comprising a grip surface formed by said metal cable strands.

* * * * *